US006990302B2

(12) United States Patent
Toba et al.

(10) Patent No.: US 6,990,302 B2
(45) Date of Patent: Jan. 24, 2006

(54) PROCESS CARTRIDGE AND ELECTROPHOTOGRAPHIC IMAGE FORMING APPARATUS REGULATING THE POSITIONS OF CREASES ON A FLEXIBLE MEMBER IN ACCORDANCE WITH PIVOTAL MOVEMENT OF A SUPPORT MEMBER

(75) Inventors: Shinjiro Toba, Shizuoka (JP); Kazunari Murayama, Shizuoka (JP); Nobuharu Hoshi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 71 days.

(21) Appl. No.: 10/715,485

(22) Filed: Nov. 19, 2003

(65) Prior Publication Data

US 2004/0126136 A1 Jul. 1, 2004

(30) Foreign Application Priority Data

Nov. 20, 2002 (JP) ..... 2002-337097

(51) Int. Cl.
*G03G 21/18* (2006.01)
*G03G 21/16* (2006.01)
*G03G 15/02* (2006.01)

(52) U.S. Cl. ..... 399/114; 399/111; 399/116

(58) Field of Classification Search ..... 399/111, 399/114, 116, 117, 159
See application file for complete search history.

(56) References Cited

U.S. PATENT DOCUMENTS

| | | | | |
|---|---|---|---|---|
| 4,470,689 | A * | 9/1984 | Nomura et al. | 399/114 |
| 5,231,453 | A | 7/1993 | Nakai et al. | |
| 5,565,961 | A * | 10/1996 | Shoji et al. | 399/111 |
| 5,708,922 | A * | 1/1998 | Azuma et al. | 399/111 |
| 5,740,499 | A | 4/1998 | Higeta et al. | 399/105 |
| 5,809,374 | A | 9/1998 | Tsuda et al. | 399/111 |
| 6,002,896 | A * | 12/1999 | Miyamoto et al. | 399/114 |
| 6,078,763 | A | 6/2000 | Hoshi | 399/111 |
| 6,091,916 | A | 7/2000 | Dycher | 399/114 |
| 6,131,011 | A | 10/2000 | Kojima et al. | 399/351 |
| 6,157,792 | A | 12/2000 | Mori et al. | 399/24 |
| 6,178,301 | B1 | 1/2001 | Kojima et al. | 399/98 |
| 6,266,503 | B1 | 7/2001 | Murayama et al. | 399/117 |
| 6,282,390 | B1 * | 8/2001 | Miyabe et al. | 399/111 |
| 6,289,189 | B1 | 9/2001 | Numagami et al. | 399/111 |
| 6,298,217 | B1 | 10/2001 | Murayama et al. | 399/358 |
| 6,314,266 | B1 | 11/2001 | Murayama et al. | 399/353 |
| 6,385,416 | B1 | 5/2002 | Horikawa et al. | 399/111 |

(Continued)

FOREIGN PATENT DOCUMENTS

JP 62-278575 12/1987

(Continued)

*Primary Examiner*—Sandra L. Brase
(74) *Attorney, Agent, or Firm*—Fitzpatrick, Cella, Harper & Scinto

(57) ABSTRACT

A process cartridge including a flexible member capable of taking a protection position in which the flexible member protects an electrophotographic photosensitive member, and a retraction position in which the flexible member retracts from the protection position, a support member having a support portion on which the flexible member is supported, provided pivotably on a cartridge frame and adapted to move the flexible member from the protection position to the retraction position, and a regulating member provided on the flexible member so as to regulate the positions of creases which occur on the flexible member in accordance with a pivotal movement of the support member, and which extend in parallel with the longitudinal direction of the member of an electrophotographic photosensitive member, the flexible member being folded on the creases and moved to the retraction position.

8 Claims, 10 Drawing Sheets

U.S. PATENT DOCUMENTS

| | | | | |
|---|---|---|---|---|
| 6,404,996 | B1 | 6/2002 | Mori et al. | 399/24 |
| 6,424,811 | B1 | 7/2002 | Tsuda et al. | 399/167 |
| 6,442,359 | B1 | 8/2002 | Numagami et al. | 399/111 |
| 6,448,994 | B1 * | 9/2002 | Kim et al. | 399/116 X |
| 6,463,233 | B2 | 10/2002 | Kojima et al. | 399/111 |
| 6,519,431 | B1 | 2/2003 | Toba et al. | 399/111 |
| 6,542,706 | B2 | 4/2003 | Toba et al. | 399/111 |
| 6,549,736 | B2 | 4/2003 | Miyabe et al. | 399/111 |
| 6,577,831 | B1 | 6/2003 | Kojima et al. | 399/111 |
| 6,603,939 | B1 | 8/2003 | Toba et al. | 399/103 |
| 6,608,980 | B2 | 8/2003 | Murayama et al. | 399/111 |
| 2002/0057924 | A1 | 5/2002 | Ueno et al. | |
| 2002/0076236 | A1 | 6/2002 | Toba et al. | 399/111 |
| 2002/0085854 | A1 | 7/2002 | Numagami et al. | 399/90 |
| 2003/0049036 | A1 | 3/2003 | Ueno et al. | 399/25 |
| 2003/0170044 | A1 | 9/2003 | Ueno et al. | 399/103 |

FOREIGN PATENT DOCUMENTS

| | | | |
|---|---|---|---|
| JP | 06-186793 | A | 7/1994 |
| JP | 10-240100 | A | 9/1998 |
| JP | 2001-282078 | | 10/2001 |

* cited by examiner

PROCESS CARTRIDGE AND ELECTROPHOTOGRAPHIC IMAGE FORMING APPARATUS REGULATING THE POSITIONS OF CREASES ON A FLEXIBLE MEMBER IN ACCORDANCE WITH PIVOTAL MOVEMENT OF A SUPPORT MEMBER

BACKGROUND OF THE INVENTION

1. Field of the Invention

This invention relates to a process cartridge detachably attachable to an electrophotographic image forming apparatus body, and an electrophotographic image forming apparatus to and from which the process cartridge can be attached and detached.

The electrophotographic image forming apparatus referred to above is an apparatus for forming an image on a recording medium by using an electrophotographic image forming system. Such electrophotographic image forming apparatuses include, for example, an electrophotographic copying machine, an electrophotographic printer (for example, a laser beam printer and a LED printer), facsimile machine, and a word processor.

The process cartridge mentioned above is formed by combining at least one of a charging means, a developing means and a cleaning means as a process means with an electrophotographic photosensitive member in one body into a cartridge. This cartridge is formed so that the cartridge can be attached to and detached from an image forming apparatus body.

2. Description of the Related Art

A process cartridge system has heretofore been employed which is formed by putting together an electrophotographic photosensitive member and a charging means, a developing means and a cleaning means in one body into a cartridge, and fixing this cartridge to an image forming apparatus body so that the cartridge be detachably attachable to the apparatus body. This cartridge system enables the operability of the apparatus to be further improved, and a user to carry out the maintenance of the above-mentioned process means easily. Therefore, this cartridge system is used widely in an image forming apparatus body.

When the process cartridge in such a cartridge system is provided on an outer side of the image forming apparatus body, it is necessary that the electrophotographic photosensitive member (which will hereinafter be referred to as a photosensitive drum) be not exposed to the light. It is also necessary to prevent a user from directly contacting the photosensitive drum to cause an imperfect image to be formed. Therefore, light shielding shutters for covering the photosensitive drum therewith are used. These shutters are made of rigid parts formed out of mainly a resin in many cases.

However, since the shutters are made of rigid members, a space for providing a path along which the shutters are opened and closed, and for storing the shutters is needed.

Under the circumstances, shutters made of a flexible film sheet so as to reduce the space for storing the shutters therein have been devised (refer to, for example, JP-A-2001-282078).

Also, shutters formed by providing a plurality of reinforcement members on flexible sheet members so that the resultant products can be folded like bellows in the longitudinal direction and stored in such a space have been devised (refer to, for example, JP-A-62-278575).

Shutter structures formed out of a flexible material so as to reduce a shutter storage space, and wound up during the use of the shutters to cause a photosensitive drum to be exposed have also been devised (refer to, for example, U.S. Pat. No. 5,231,453).

Shutter structures formed by joining thin, narrow plates together by hinges are drawn into a predetermined storage portion of a process cartridge have also been devised (refer to, for example, U.S. Pat. No. 6,091,916).

The present invention has been attained on the basis of the above-described related techniques by making further improvements thereon.

SUMMARY OF THE INVENTION

An object of the invention is to provide a process cartridge capable of protecting an electrophotographic photosensitive member by a simple structure, and an electrophotographic image forming apparatus using the same cartridge.

Another object of the invention is to provide a space-saving process cartridge, and an electrophotographic image forming apparatus using the same cartridge.

Another object of the invention is to provide a simply constructed process cartridge, and an electrophotographic image forming apparatus using the same cartridge.

Another object of the invention is to provide a process cartridge adapted to prevent a large deflection of a flexible member and move the flexible member smoothly to a retraction position, and an electrophotographic image forming apparatus using the same cartridge.

Another object of the invention is to provide a process cartridge having a regulating member on the flexible member for the purpose of regulating positions of creases which occur on the flexible member in accordance with a pivotal movement of a support member, and which extend in parallel with the longitudinal direction (or the axis of rotation) of an electrophotographic photosensitive member; and capable of having the flexible members being able to be folded on the creases and moved to positions of retraction.

DESCRIPTION OF THE PREFERRED EMBODIMENTS

Preferred modes of embodiments of the present invention will now be described illustratively with reference to the drawings. The size, material, shape and the relative arrangement of the constituent parts described in these modes of embodiments do not signify that the scope of the invention is limited thereto unless any specific description thereof is given. The material and shape, which will once be described in the following statement, of members are identical with those of the same members as are described first unless any special description thereof will be newly given.

(First Embodiment)

[Description of the Electrophotographic Image Forming Apparatus As a Whole]

Figure 2:
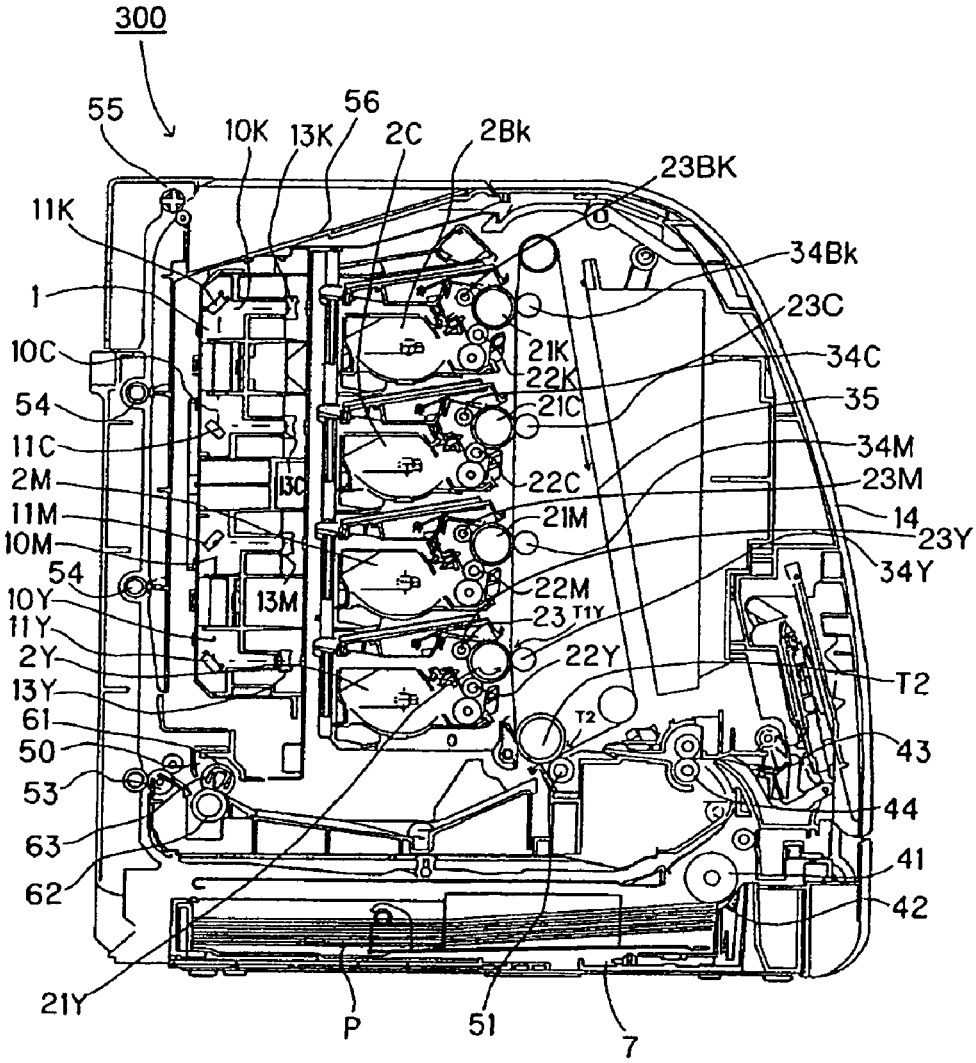
FIG. 2 is a schematic sectional view of the first embodiment of an image forming apparatus according to the present invention.

First, the general construction of the electrophotographic image forming apparatus (which will hereinafter be referred to as an "image forming apparatus") will be described with reference to FIG. 2. FIG. 2 is a schematic sectional view of a first embodiment of the image forming apparatus according to the present invention. To be more concrete, the drawing is an explanatory drawing of the general construction of a color laser beam printer constituting a mode of a color image forming apparatus.

As shown in FIG. 2, an image forming apparatus 300 (color laser beam printer) has a process cartridge 2 (2Y, 2M, 2C, and 2Bk) fixed thereto. The cartridge 2 has an electrophotographic sensitive member (which will hereinafter be referred to as a "photosensitive drum") 21 (21Y, 21M, 21C, and 21Bk) rotated at a predetermined speed for each of various colors Y, M, C and Bk. The image forming apparatus also has an intermediate transfer member 35. The intermediate transfer member 35 is a part for retaining a color image thereon which is developed in the cartridge 2 and multiplexly-transferred to the intermediate transfer member, and further transferring the same image to a recording medium P sent from a feed unit. The image forming apparatus 300 further has a fixing unit 50 for fixing the color image on a color image-transferred recording medium P, and discharge roller pairs 53, 54, and 55 for discharging the recording medium P onto a discharge tray 56 provided on an upper surface of the apparatus. The above-mentioned cartridges 2Y, 2M, 2C, and 2Bk for images of four colors are formed so that the cartridges can be separately attached to and detached from the main body of an image forming apparatus.

The construction of each unit of the image forming apparatus 300 will now be described.

[Electrophotographic Photosensitive Member]

The photosensitive drum 21 (21Y, 21M, 21C, and 21Bk) constituting an electrophotographic photosensitive member is formed by applying a layer of an organic photo conductor to an outer circumferential surface of an aluminum cylinder. The photosensitive drum 21 is supported rotatably in a container 24 (24Y, 24M, 24C, and 24Bk). A driving force of a driving motor (not shown) is transmitted to one end of the photosensitive drum 21. This causes photosensitive drum 21 to be rotated in accordance with an image forming operation.

[Charging Means]

The charging means uses a contact charging system, in which a conductive charging roller 23 (23Y, 23M, 23C, and 23Bk) formed in the shape of a roller is brought into contact with a surface of the photosensitive drum 21. Simultaneously with the charging roller engaging operation, the surface of the photosensitive drum 21 is charged uniformly by applying a voltage to the charging roller 23 (23Y, 23M, 23C, and 23Bk).

[Exposure Means]

A scanner unit 1 exposes the photosensitive drum 21. An image signal is given to a laser diode. This laser diode applies image forming light (10Y, 10M, 10C, and 10Bk) corresponding to the image signal to a polygon mirror (11Y, 11M, 11C, and 11Bk). This polygon mirror is rotated at a high speed by a scanner motor. The image light reflected on the polygon mirror exposes the surface of the photosensitive drum 21 selectively which is rotated at a predetermined speed via an image forming lens (13Y, 13M, 13C, and 13Bk). As a result, an electrostatic latent image is formed on the photosensitive drum 21.

[Developing Means]

A developing means develops the electrostatic latent image into a visible image. For this purpose, the developing means is formed by four development units capable of developing images of each of the colors including yellow, magenta, cyan, and black. Each development unit (222Y, 222M, 222C, and 222Bk) for images of four colors is opposed to the photosensitive drum 21 and disposed in a position in which a developing roller 22 (22Y, 22M, 22C, and 22Bk) contacts the photosensitive drum 21 as the roller is rotated. A visible image made of a toner of each color is then formed on the photosensitive drum 21.

[Intermediate Transfer Member]

An intermediate transfer member 35 multiplexly transfers thereto during a color image forming operation a toner image made visible by each cartridge 2 (2Y, 2M, 2C, and 2Bk) and formed on the photosensitive drum 21. For this purpose, the intermediate transfer member is rotated clockwise on the drawing and synchronously with a peripheral speed of the drum 21 of a photosensitive material 21. The toner image formed on the photosensitive drum 21 is multiplexly transferred onto the intermediate transfer member 35 in a primary transfer section, which constitutes a contact point with respect to a voltage-applied primary transfer roller (34Y, 34M, 34C, and 34Bk) disposed in a position opposed to the photosensitive drum 21 with the intermediate transfer member 35 held therebetween.

The intermediate transfer member 35 to which the toner image was multiplexly transferred is sent forward in a secondary transfer area T2 with the recording medium P held between a voltage-applied transfer roller 51 and drum 21 of photosensitive member, and thereby simultaneously and multiplexly transfers the toner images of various colors on the intermediate transfer member 35 onto the recording medium P.

[Feed Unit]

A feed unit feeds a recording medium (for example, recording paper and OHP sheet) P to the image forming unit. The feed unit has mainly a feed cassette 7 in which a plurality of sheets of recording media P are stored, a feed roller 41, a separating pad 42, a feed guide 43 and a resist roller pair 44. During an image forming operation, the feed roller 41 is driven and rotated in accordance with an image forming action, and feeds the recording media P in the feed cassette 7 while separating the recording media P sheet by sheet. At the same time, the recording media are guided by the feed guide 43 and reach the resist roller pair 44 via transfer rollers.

During the image forming operation, the resist roller pair 44 carry out in a predetermined sequence a non-rotational operation for stopping on standby the recording medium P and a rotational operation for transferring the recording medium P toward the intermediate transfer member 35. The aligning of the image used in a transfer step, a subsequent step with the recording medium P is then done.

[Transfer Unit]

A transfer unit includes a transfer roller 51. In this stage of the image forming operation, the intermediate transfer member 35 and transfer roller 51 are driven respectively. Therefore, the recording medium P held between these rollers is subjected to a transfer step, and, at the same time, transferred (in the leftward direction of the drawing) at a predetermined speed. The recording medium P is then transferred toward a fixing unit 50 in which a subsequent step is carried out.

[Fixing Unit]

The fixing unit 50 is a unit for fixing the toner image formed on the recording medium P by the developing unit via the intermediate transfer member 35. The fixing unit 50 has a film guide unit 61 in which a ceramic heater 63 for applying heat to the recording medium P is contained, and a pressure roller 62 for bringing the recording medium P into pressure contact with the film guide unit 61. That is, the toner image-retaining recording medium P is transferred by the film guide unit 61 and pressure roller 62, and the toner image is fixed on the recording medium P owing to the heat and pressure applied to the recording medium P.

[Image Forming Operation]

An operation in a case where the formation of an image is carried out by the apparatus constructed as described above will now be described.

First, the feed roller 41 shown in FIG. 2 is rotated, and one piece of recording medium P in the feed cassette 7 is separated and transferred to the resist roller pair 44.

On the hand, the photosensitive drum 21 and intermediate transfer member 35 are rotated at respective predetermined peripheral speeds V (which will hereinafter be referred to as process speeds) in the direction of an arrow in the drawing.

The photosensitive drum 21 the surface of which was charged uniformly by the charging unit 23 receives the image forming light 10, and carries out the formation of an image.

Since the operations for forming images of various colors are identical, the formation of a yellow image will be described in the following paragraphs.

The irradiation of the yellow image forming light is conducted by the scanner unit to form a yellow latent image on the photosensitive drum 21Y. Simultaneously with the formation of this latent image, the yellow image developing roller 22Y is driven, and the developing of the yellow image is done by applying to the photosensitive drum 21Y a voltage the polarity and potential of which are substantially identical with those of the photosensitive drum 21Y so that the yellow toner is deposited on the latent image on the same drum. At the same time, the yellow toner image on the photosensitive drum 21Y is primarily transferred to an outer circumference of the intermediate transfer member 35 in a primary transfer area T1Y provided on the downstream side of the developing area. During this time, the primary transfer of the toner image is carried out with a voltage the characteristics of which are contrary to those of the yellow toner applied to the intermediate transfer member 35.

Magenta, cyan and black images are formed in the same manner as mentioned above. The formation of latent images, the development thereof and the transfer of toner to the intermediate transfer member 35 of the yellow, magenta, cyan and black images are carried out in the mentioned order of colors in the respective primary transfer positions. As a result, a full-color image made of four kinds of toners including yellow, magenta, cyan and black toners is formed on the surface of the intermediate transfer member 35.

Before a front end of the full-color image, which was formed on the intermediate transfer member 35 after the primary transfer of the black toner, a fourth color toner had finished, the recording medium P stopped on standby at the previously-mentioned resist roller pair 44 is sent out at suitable timing.

When the images of the four colors are formed on the intermediate transfer member 35, the transfer roller 51 stopped on standby in a lower position and not in contact with the intermediate transfer member 35 is moved up at the same time by a cam (not shown), and the recording medium P is brought into pressure contact with the intermediate transfer member 35 in a secondary transfer area T2. Simultaneously with this operation, a bias voltage the characteristics of which are contrary to those of the toner is applied to the transfer roller 35.

Thus, a full-color image having four colors on the intermediate transfer member 35 is transferred at a time onto the recording medium P.

The recording medium P passing through the secondary transfer area T2 is peeled off from the intermediate transfer member 35, transferred to the fixing unit and subjected to a toner fixing operation. The recording medium P is then discharged with an image surface directed downward onto the discharge tray 56 via the discharge rollers 53, 54, and 55 to finish the image forming operation.

[Attaching and Detaching of the Process Cartridge]

Figure 3:
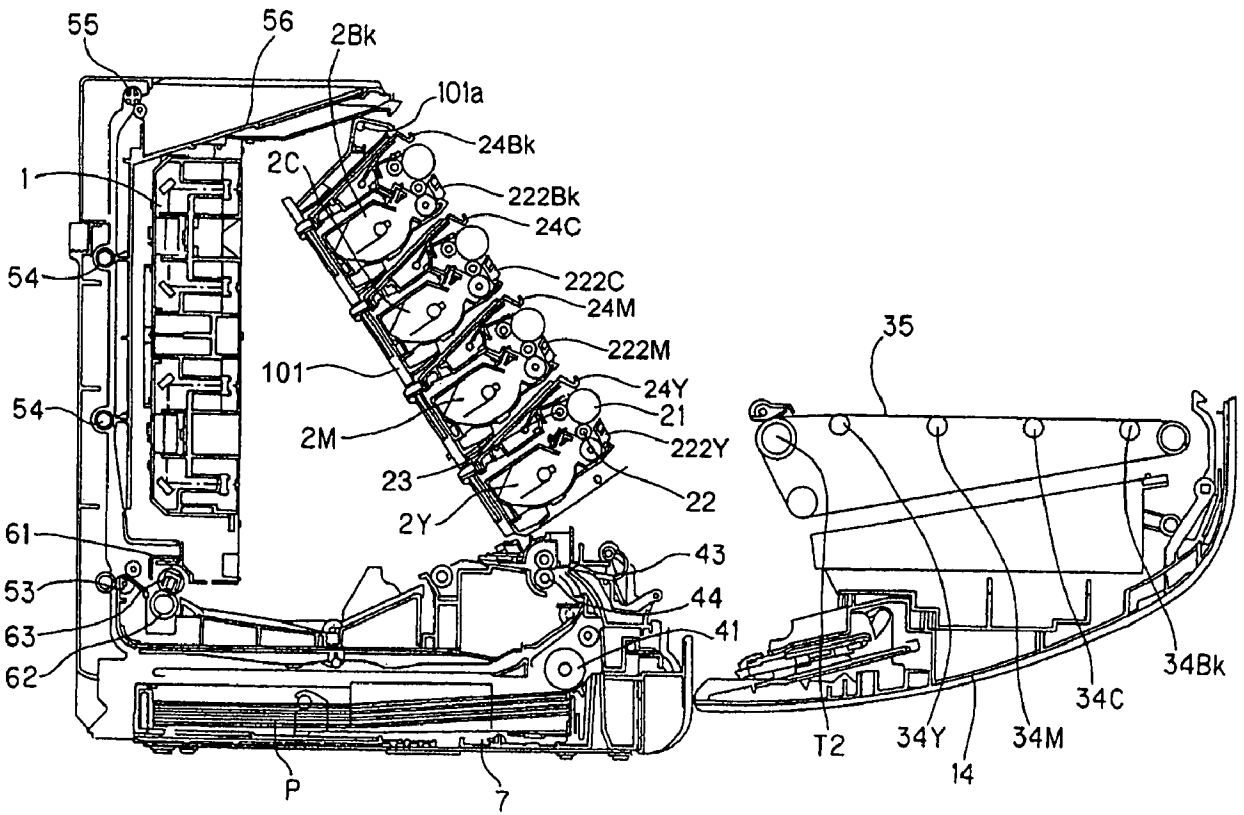
FIG. 3 is a sectional view showing the condition of attaching and detaching the first embodiment of the process cartridge according to the present invention to an apparatus body.

A method of attaching and detaching the cartridge 2 to and from the main body of the apparatus will now be described with reference to FIG. 3. FIG. 3 is a sectional view showing the condition of attaching and detaching the cartridge 2 of the second embodiment of the present invention to and from the main body of the image forming apparatus.

A front cover 14, which is fixed to a unit in one body which unit includes the intermediate transfer member 35, for the apparatus body is opened rightward (in the frontward direction of the apparatus body). As a result, a cartridge storage guide 101 holding four cartridges 2 therein is exposed. As a result, the cartridge storage guide is inclined at an angle of about 35° around a center 101*a* of a pivotal movement thereof. This enables the operations for attaching and detaching the cartridge 2 to and from the main body of the apparatus to be carried out.

Figures 4A, 4B:
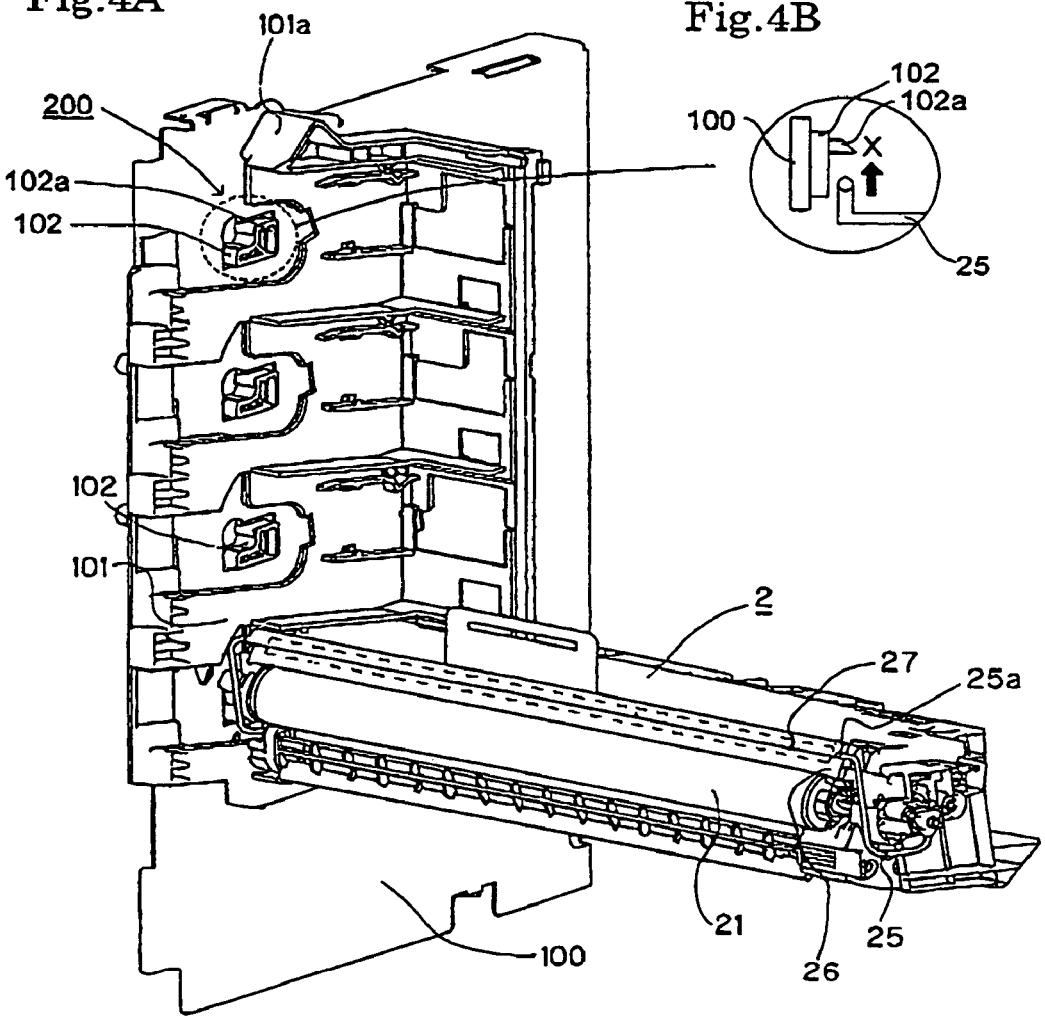
FIG. 4A is a perspective view showing the condition in which the first embodiment of the process cartridge according to the present invention is fixed to a cartridge storage guide.
FIG. 4B is a schematic view for describing a mechanism of opening a shutter of a photosensitive drum when the cartridge storage guide is inserted into the image forming apparatus.

FIG. 4A is a perspective view showing the condition of the cartridge 2 fixed to the cartridge storage guide.

The cartridge 2 is inserted with the cartridge retained in the cartridge storage guide 101 into the main body of the image forming apparatus with the center 101*a* of a pivotal movement of the guide 101 positioned in the center of the main body of the apparatus. The cartridge is finally fixed to a mount 200. The position of the cartridge is determined by a cartridge support member 102, which is combined with a left side plate 100 of the apparatus body, and a photosensitive drum coupling (not shown).

[Construction of Protective Member for Electrophotographic Photosensitive Member]

Figure 1:
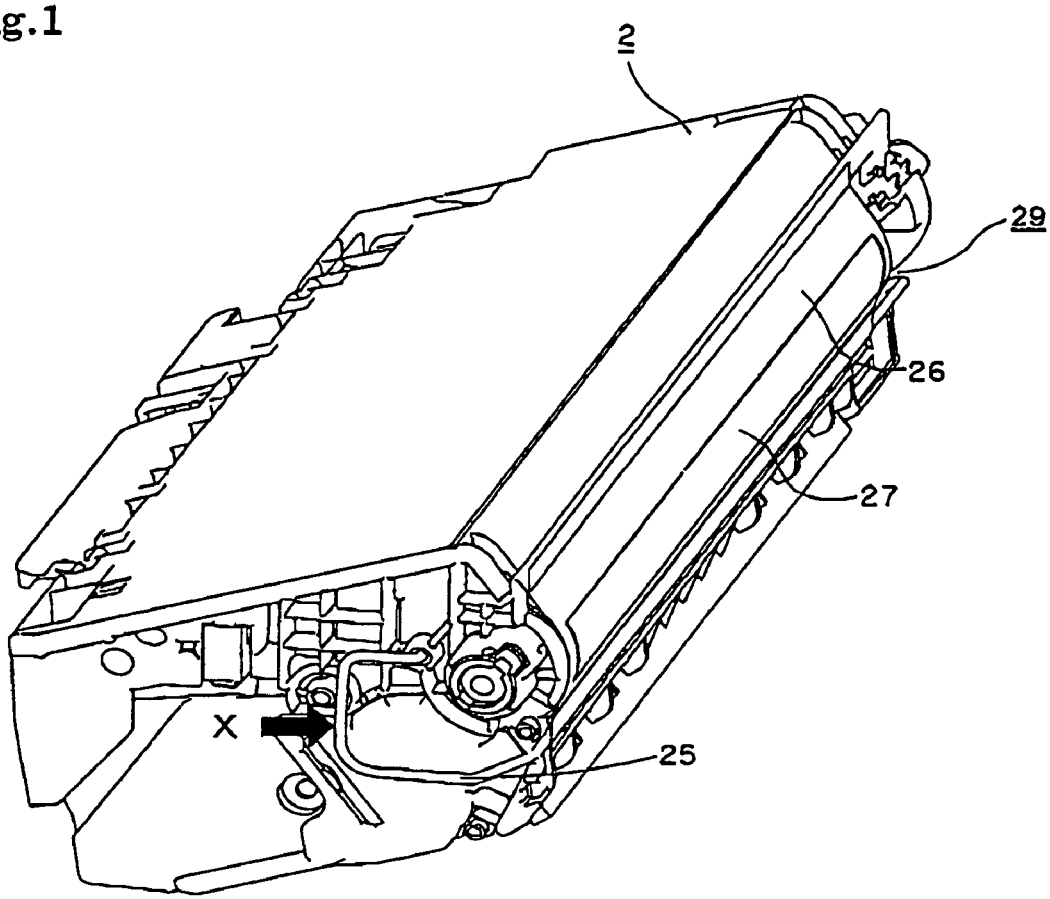
FIG. 1 is a perspective view of a first embodiment of the process cartridge according to the present invention.

The construction of a protective member (drum shutter) for the photosensitive drum in the first embodiment will now be described with reference to FIG. 1. FIG. 1 is a perspective view of the first embodiment of the process cartridge according to the present invention.

A drum shutter 29 provided on this embodiment of the cartridge 2 has a pivotable rod type support member 25 on a flexible member 26. A regulating member 27 for regulating a crease of the flexible member 26 is fixed to the same member 26.

In this embodiment, a flexible member 26 of a thickness of up to around 20 $\mu$m to 500 $\mu$m can be used. The thickness may be selected from levels in the range which does not spoil the storing ability, which will be described later, of the flexible member. In short, a flexible material may be used for this member even when the thickness thereof is large, and, when fiber (cloth) having a flexibility is used, the thickness thereof can be set to even not smaller than 1 mm.

The flexible member 26 in the first embodiment uses a PE (polyethylene) film of around 100 $\mu$m in thickness.

In this embodiment, other materials, such as PP (polypropylene) and an elastomer-based film can also be suitably selected.

In order to shield the photosensitive drum 21 from the light, the flexible member 26 in the first embodiment is colored black. Besides such a colored flexible member 26, a carbon-containing conductive film (having, for example, a surface resistance value of not higher than $10^{10}$ Ω/square) can also be used. The aforementioned structure improves light shielding ability, so that damage to the photosensitive drum 21 can be prevented, and, moreover, the flexible member 26 turns into a conductive film owing to the carbon contained therein. This enables the charging of a memory with static electricity to be prevented.

The regulating member 27 in this embodiment is made of a plate type reinforcing member the material of which is more rigid than that of the flexible member 26, and fixed on the flexible member 26. The fixing method for the regulating member may be any one of the methods using an adhesive double-coated tape, a bonding agent and heat sealing techniques. In the first embodiment, a PET (polyethylene terephthalate) sheet of around 100 $\mu$m in thickness is pasted on the flexible member 26.

The regulating member 27 may be used not as a reinforcing member but as a member on which letters are printed, or on which colored letters are shown, for the purpose of having a user know a position in which each cartridge should be fixed. Owing to this structure, the user's visibility of the parts is heightened, and the controllability of the cartridge 2 during an operation for fixing the cartridge to the main body of the image forming apparatus 300 is improved. Moreover, fixing a cartridge of a different color erroneously to the main body of the apparatus can be prevented.

Although the regulating member 27 is provided on an outer surface of the flexible member 26 in the first embodiment, the regulating member may also be provided on both the outer and inner surfaces thereof. The regulating member 27 may also be provided on the inner surface (the surface facing the electrophotographic photosensitive member) only. In this case, however, a material which does not damage the surface of the electrophotographic photosensitive member, and a material which does not generate an electrostatic memory on the electrophotographic photosensitive member may be selected as the material used on the inner surface of the flexible member.

[Opening and Closing of the Protective Member for the Electrophotographic Photosensitive Member]

The drum shutter storing condition will now be described with comparative reference to FIGS. 4B, 5, 8 and 9. FIG. 4B is a schematic sectional view showing a structure for opening the shutter for the photosensitive drum when the cartridge storage guide is inserted into the image forming apparatus. FIG. 5 is a schematic sectional view showing the condition of the drum shutter provided in the first embodiment of the present invention. FIG. 8 is a schematic sectional view showing the condition of the storing of the drum shutter on the assumption that the regulating member is not provided thereon, so as to describe the effect of the first embodiment of the present invention. FIG. 9 is a schematic sectional view showing the condition of the storing of the drum shutter on the assumption that the drum shaft is made of a rigid member, so as to describe the effect of the first embodiment of the present invention. As described above, the embodiments shown in FIGS. 8 and 9 are made assumptively so as to describe the effects of the embodiments of the present invention easily understandably, and were not known at the time of filing the patent application of the invention.

As shown in FIG. 4B, the cartridge 2 is inserted into the main body of the image forming apparatus with the cartridge retained in the cartridge storage guide 101. As a result, a support member 25 engages a projection 102*a* as a moving member extending from a cartridge support member 102. When the cartridge storage guide 101 is further turned to cause the cartridge 2 to be moved to a deep portion of the main body of the image forming apparatus, the support member 25 is pushed in the direction of an arrow X in FIG. 1. As a result, the shutter 29 of the photosensitive drum 21 provided on the cartridge 2 is opened.

That is, the support member 25 engages the projection 102*a* in accordance with an operation for fixing the cartridge 2 to the mount 200. As a result, the support member 25 is moved just as the flexible member 26 which moves from a protection position to a retraction position.

The action (opening action) of the shutter 29 in the first embodiment will now be described.

First, the support member 25 makes a rotational movement from the condition (FIG. 5A) in which the shutter 29 of the photosensitive drum 21 covers the same drum. The flexible member 26 is supported at one side 26*a* thereof on a support portion 25*a* of the support member 25, and at the other side 26*b* thereof on a support portion 2*a* of the main body of the cartridge 2. In the condition in which the flexible member 26 covers the photosensitive drum 21, the flexible member 26 is bent to an outer side of the cartridge 2 so that the flexible member does not contact the photosensitive drum 21.

When the rotational movement of the support member is started, a crease 26Q occurs (FIG. 5B) first in a region between the regulating member 27 and the support portion 25*a* of the film support member 25 on which the first-mentioned side 26*a* of the flexible member 26 is supported. The reason resides in that the rigidity of a region made of the flexible member 26 only is lower than that of a region in which the regulating member 27 is provided. This causes a crease to occur selectively even when the same level of force is exerted on each region. Therefore, when the regulating member 27 is provided, the crease on the flexible member 26 is fixed, or the curvature of a crease on a film can be freely set. In addition, the operations for opening and closing the shutter 29 come to be carried out more certainly, and the reliability of such operations becomes high.

In the condition in which the flexible member 26 covers the photosensitive drum 21 as mentioned above, the flexible member 26 is bent to the outer side of the cartridge 2 so that the flexible member 26 does not contact the photosensitive drum 21. Therefore, the crease 26Q always occurs on the inner side of the flexible member 26. Accordingly, when the support member 25 further continues to be turned, the support portion 25*a* thereof passes (FIG. 5C) through the region between the regulating member 27 and the photosensitive drum 21.

Figure 5A:
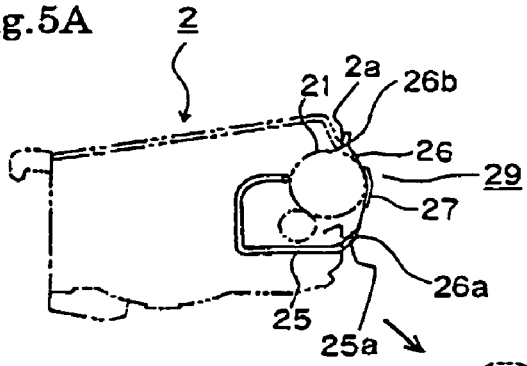
FIG. 5 is a schematic sectional view showing the condition of the storing of the drum shutter in the first embodiment of the present invention.
Figure 5B:
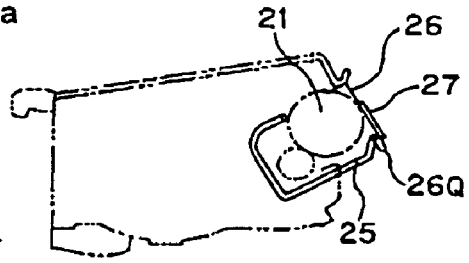
Figure 5C:
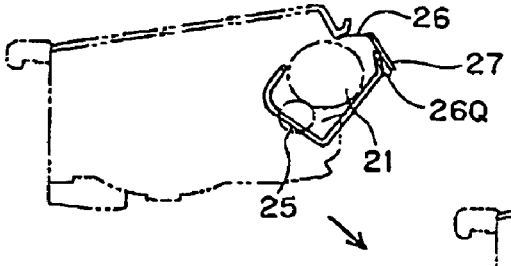
Figure 5D:
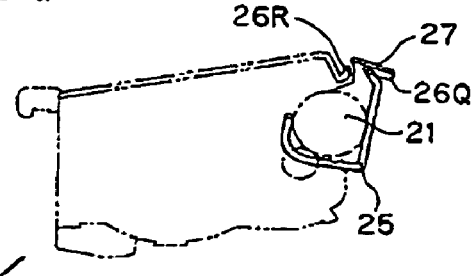

At nearly this time, a new crease 26R occurs (FIG. 5D in a region between the regulating member 27 and the support portion 2*a* at which the cartridge 2 supports the second-mentioned side 26*b* of the flexible member 26.

Figure 5E:
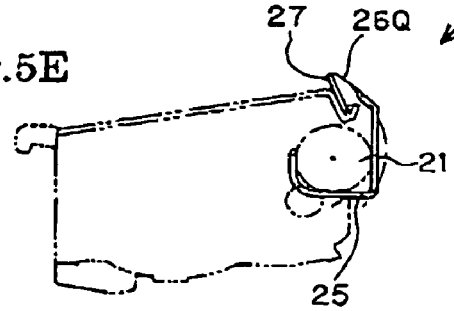

When the support member 25 further continues to be turned, the regulating member 27 continues to retract leftward (to the rear side of the cartridge) in the drawing up to a final storage position (FIG. 5E).

During this time, the regulating member 27 is folded back owing to the upward movement in the drawing of the first-mentioned side 26*a* of the flexible member 26, which is supported on the support member 25, from the second-mentioned side 26*b* thereof supported on the cartridge 2. As a result, the flexible member 26 is folded in the direction crossing the longitudinal direction (or the axis of rotation) of the photosensitive drum 21. This enables the shutter 29 to be compactly folded. A space for storing the drum shutter does not need to be secured widely unlike the similar space in the related art apparatus, so that a high-degree space-saving can be attained.

The flexible member 26 has the first crease 26Q occurring in such a region in accordance with the pivotal movement of the support member 25 that is between the regulating member 27 and support portion 25*a* at which the support member 25 supports the flexible member 26 thereon. Moreover, the flexible member 26 has the second crease 26R occurring in such a region in accordance with the further pivotal movement of the support member 25 that is between the regulating member 27 and support portion 2*a* at which the cartridge 2 supports the flexible member 26. This enables the shutter 29 to be folded more compactly as compared with the shutter having one crease.

When the regulating member 27 is used as described above, the shutter can be set so that the creases are generated in desired positions, by simply constructed, small number of parts, and the manufacturing cost can be advantageously reduced.

Furthermore, when the regulating member 27 is provided, a planar portion is formed, so that the slackening of the flexible member 26 is prevented. That is, the flexible member 26 does not contact the photosensitive drum 21, so that the hurting of the photosensitive drum 21 can be prevented. Moreover, the protecting performance of the flexible member with respect to the photosensitive drum 21 is high as compared with a flexible member having a flexible film only thereon.

The order of generating the creases, the number of the creases and the size thereof can be changed by varying the position in which the regulating member is pasted on the flexible member, the number of the regulating member fixed to the flexible member, the material of which the flexible film is made, a path along which the film support member is moved. The first embodiment showed one example of these methods.

A drum shutter closing operation is substantially contrary to the above-described drum shutter opening operation. As described above, when, for example, the paths of the support member 25 for supporting the flexible member are set different in the shutter opening and closing operations, the same operations can be set separately.

According to the construction of the first embodiment, the flexible member can carry out a predetermined deformation operation repeatedly in accordance with the pivotal movement of the support member while attaining the saving of a space, in such a manner that the flexible member does not interfere with the electrophotographic photosensitive member. That is, a large deflection of the flexible member is prevented by regulating the positions of creases occurring on the flexible member by the regulating member provided thereon. At the same time, the flexible member can be folded in a retraction position thereof in a space-saving manner.

For example, a mode of embodiment in which a drum shutter 30 is stored with a regulating member 27 not provided as shown in FIG. 8 is supposed. In this embodiment, a crease 150Q having a large radius of curvature is formed in a flexible member 150 to occupy a useless space. In this case, the crease 150Q occurring in accordance with the pivotal movement of a support member 151 necessarily contacts an intermediate transfer member 35 (FIG. 8E). The crease 150Q is formed in the position shown in the drawing, and, in some other cases, at the opposite side thereof, in which case a space on the side of an upper surface of the cartridge 3 is wasted.

As shown in FIG. 9, a mode of embodiment in which a drum shutter 28 of a rigid material is stored is supposed. In such a case, the necessity of securing a sufficient space around a path along which the shutter 28 moves occurs in some cases when the shutter makes its opening action. For example, it is necessary to secure a space of a size H shown in the drawing, in the direction the height, and a space of a size W shown in the drawing, in the substantially horizontal direction. Therefore, the cartridge 4 cannot attain the saving of a space therefor, and the dimensions of an image forming apparatus to and from which the cartridge 4 can be attached and detached increase in some cases.

For these reasons, the previously-described effects of the first embodiment cannot be obtained in the structures described with reference to FIGS. 8 and 9.

(Second Embodiment)

A second embodiment of the present invention will be described with reference to FIGS. 6, 7 and 10. The structures in this embodiment which are identical with or corresponding to those in the first embodiment will be designated by the same reference numerals, and a detailed description thereof will be omitted. Since the construction of the second embodiment of the image forming apparatus and a principal portion of a process cartridge thereof is identical with that of those of the first embodiment, the characteristic portions only of the second embodiment of the process cartridge will be described.

Figure 6:
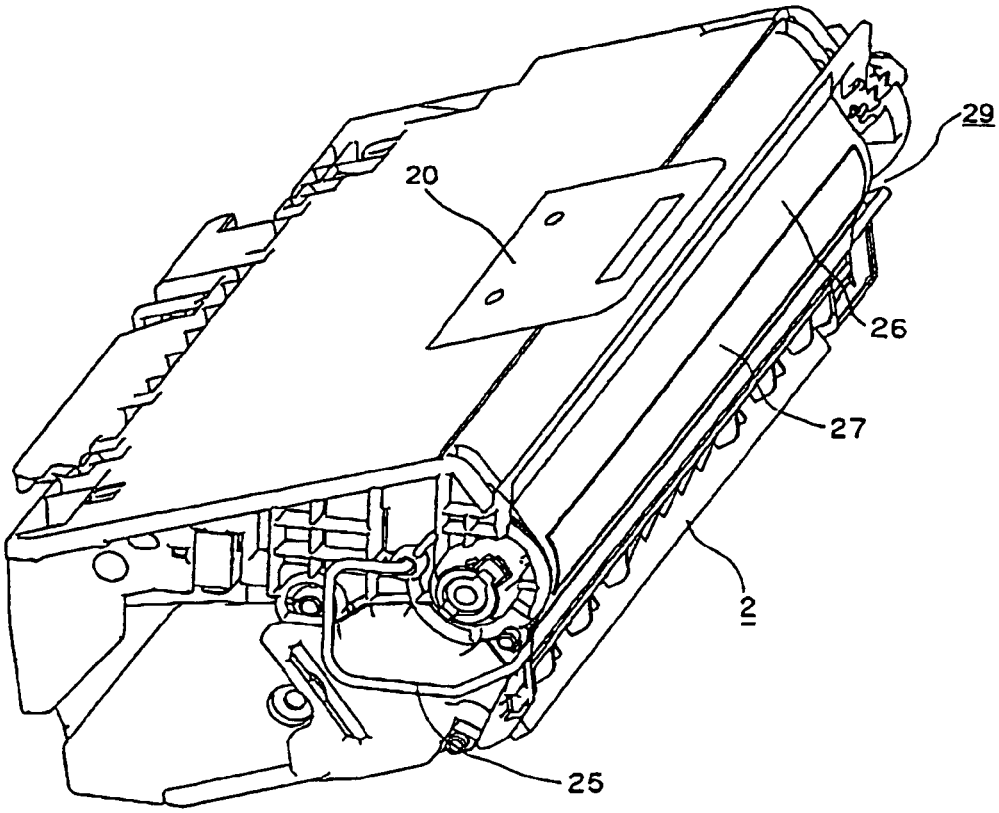
FIG. 6 is a perspective view of a second embodiment of the process cartridge according to the present invention.

FIG. 6 is a perspective view of the second embodiment of the process cartridge according to the present invention. FIG. 7 is a schematic sectional view showing the condition of a stored drum shutter in the second embodiment according to the present invention. FIG. 10 is a schematic sectional view showing the condition of a stored drum shutter supposed with a regulating member not provided, so as to describe the effect of the second embodiment of the present invention. As mentioned previously, the embodiment shown in FIG. 10 is supposed so as to describe the effect of the embodiment of the present invention easily understandably, and was not known at the time of filing of the patent application of the invention.

A cartridge 2 of the second embodiment shown in FIG. 6 is provided with a flexible handle 20. This handle 20 is provided so that a user attaches and detaches the cartridge 2 to and from the main body of the image forming apparatus with an improved controllability. The handle 20 is provided so as to project from the cartridge 2 toward the side of an intermediate transfer member 35 so that the cartridge can be held easily.

When the handle 20 is provided in the above-mentioned manner, the easiness of holding the cartridge is improved. However, when the handle is left as it is, the handle has a fear of interfering with the intermediate transfer member 35 when the cartridge 2 is fixed to the image forming apparatus. Therefore, when the handle 20 can retract in accordance with an opening action of a shutter 29, an excessive operation does not need to be carried out, so that the cartridge fixing operation can be executed conveniently.

Therefore, the shutter 29 in the second embodiment is brought into contact with the handle 20 as shown in FIG. 7, to cause the handle 20 to be deformed in the upward direction and put in a retracted state. A structure capable of retracting the handle 20 in this manner without needing any excessive operation is employed. An action (opening action) of the shutter 29 in the second embodiment will now be concretely described.

First, a support member 25 starts being turned from the condition (FIG. 7A) in which a shutter 29 covers the photosensitive drum 21. In this condition, a flexible member 26 is supported at its one side 26*a* on a support portion 25*a* of the support member 25, and at the other side 26*b* thereof on a support portion 2*a* of a main body of a cartridge 2. In the condition in which the flexible member 26 covers the photosensitive drum 21, the flexible member 26 is bent to an outer side of the cartridge 2 so as not to contact the photosensitive drum 21.

When the rotational movement of the support member 25 is started, a crease 26Q occurs (FIG. 7B) first in a region between a regulating member 27 and the support portion 25*a* of a film support member on which the first-mentioned side 26*a* of the flexible member 26 is supported. The reason why the crease occurs reside in that the rigidity of the region in which the flexible member 26 only exists is lower than that of the region in which the regulating member 27 is provided. Therefore, the crease occurs selectively even when the same level of force is exerted on each region.

In the condition in which the flexible member 26 covers the photosensitive drum 21, the flexible member 26 is bent in the outer side of the cartridge 2 so as not to contact the photosensitive drum 21 as mentioned above. Therefore, the crease 26Q always occurs on the inner side of the flexible member 26. As a result, when the support member 25 further continues to be turned, the support portion 25*a* of the support member 25 passes (FIG. 7C) through a region between the regulating member 27 and the photosensitive drum 21.

At around this time, a new crease 26R occurs (FIG. 7D) in a region between the regulating member 27 and a support portion 2*a* on which the cartridge 2 supports the second-mentioned side 26*b* of the flexible member 26.

Figure 7A:
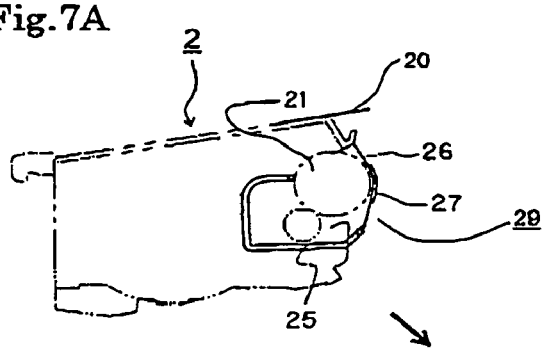
FIG. 7 is a schematic sectional view showing the condition of the storing of the drum shutter in the second embodiment of the present invention.
Figure 7B:
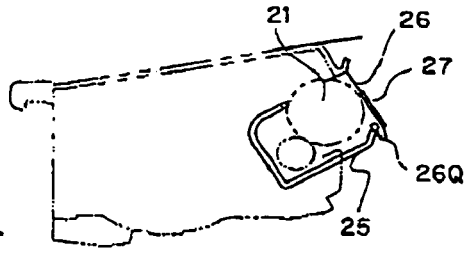
Figure 7C:
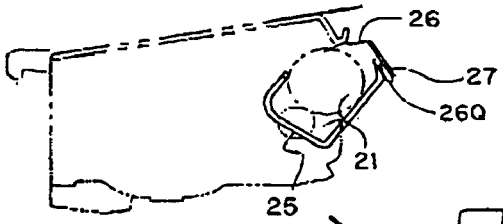
Figure 7D:
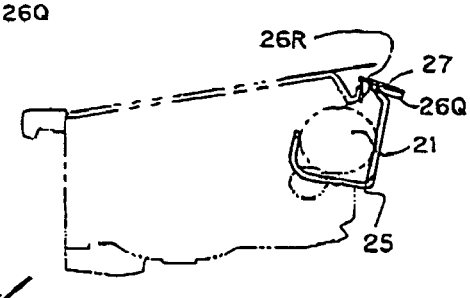
Figure 7E:
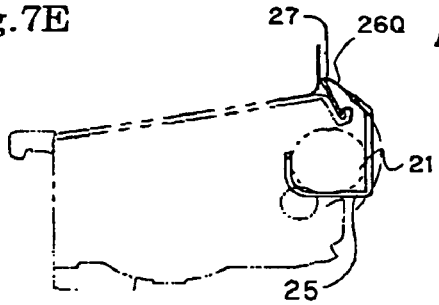
Figure 8A:
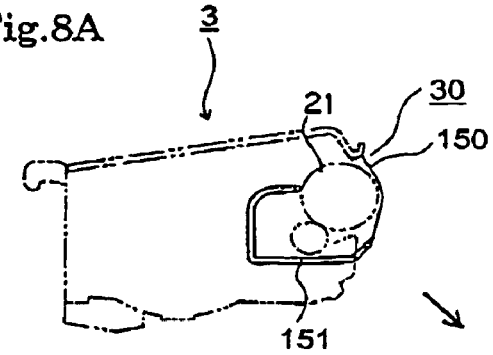
FIG. 8 is a schematic sectional view showing the condition of the storing of the drum shutter on the assumption that a regulating member is not provided, so as to describe the effect of the embodiment of the present invention.
Figure 8B:
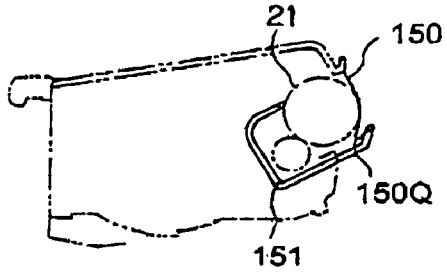
Figure 8C:
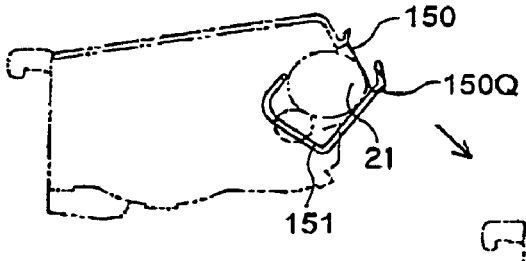
Figure 8D:
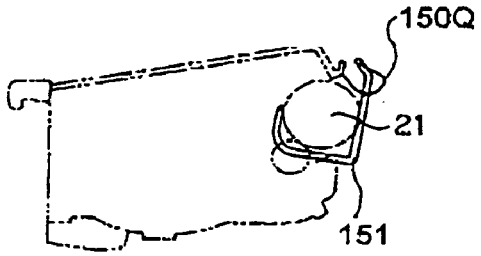
Figure 8E:
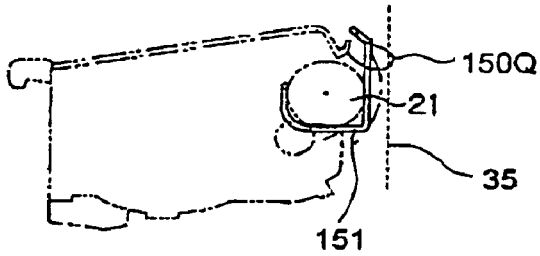
Figure 9A:
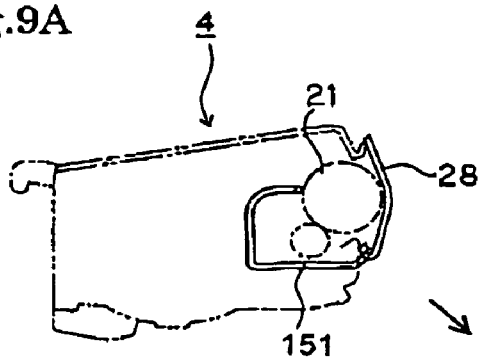
FIG. 9 is a schematic sectional view showing the condition of the storing of the drum shutter on the assumption that a rigid drum shutter is provided, so as to describe the effect of the embodiment of the present invention.
Figure 9B:
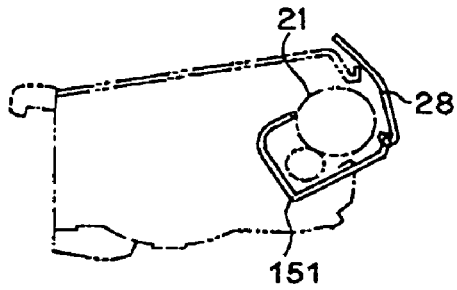
Figure 9C:
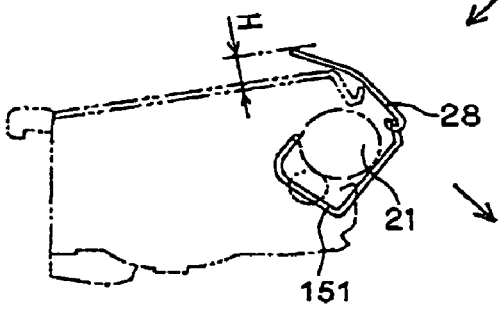
Figure 9D:
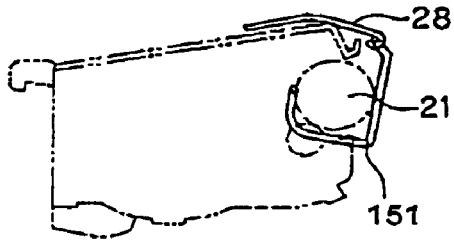
Figure 9E:
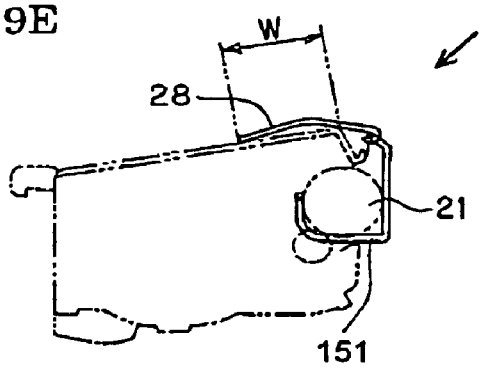
Figure 10A:
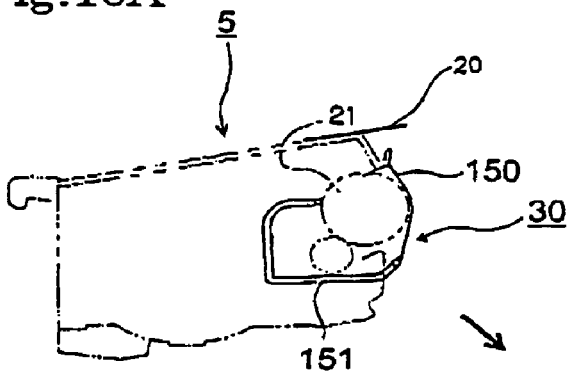
FIG. 10 is a schematic sectional view showing the condition of the storing of the drum shutter on the assumption that a regulating member is not provided, so as to describe the effect of the second embodiment of the present invention.
Figure 10B:
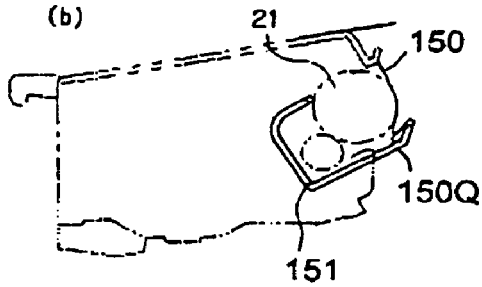
Figure 10C:
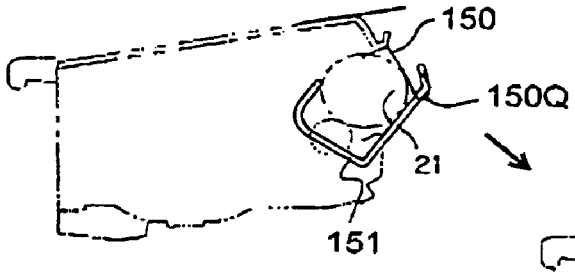
Figure 10D:
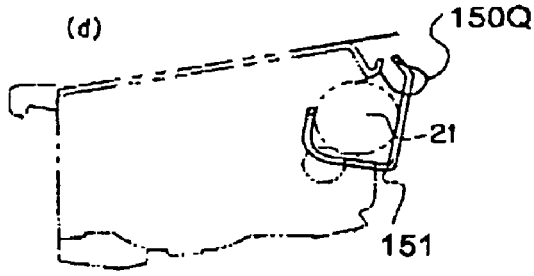
Figure 10E:
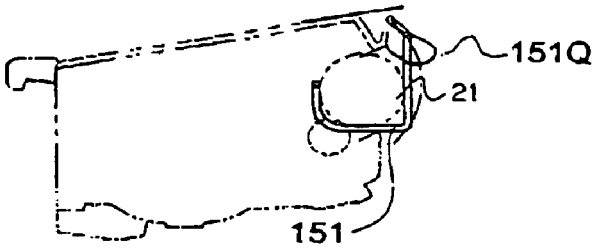

When the support member 25 further continues to be turned, the regulating member 27 continues to retract leftward (toward the rear-side of the cartridge) in the drawing up to a final storage position (FIG. 7E).

During this time, the pivotal movement of the support member 25 causes the first-mentioned side 26*a* of the flexible member 26 supported on the support member 25 to be moved to a position higher than that of the second-mentioned side 26*b* thereof supported on the cartridge 2. As a result, the regulating member 27 is folded back, and raises the handle 20 in the upward direction in the drawing (FIG. 7E).

Consequently, the handle 20 retracts from the intermediate transfer member 35. As a result, the interfering of the handle 20 and intermediate transfer member 35 with each other can be prevented simply without needing the user's special operation.

According to the second embodiment, the interfering of the handle 20 and intermediate transfer member 35 with each other can be prevented simply in addition to such an effect as is possessed by the above-described first embodiment.

As shown in FIGS. 10A to 10E, a mode of embodiment in which a shutter 30 not provided with a regulating member 27 is stored in a process cartridge is now supposed. In this case, it is conceived that a crease 150Q of a large radius of curvature is formed. As a result, the flexible member 150 does not contact the handle 20 and occupies a useless space, so that the flexible member 150 contacts (FIG. 10E) the intermediate transfer member 35. It is conceived that the crease 150Q is formed on the opposite side in some cases which is other than the position shown in the drawing. In this case, a useless space occurs on the side of an upper surface of a cartridge 5.

For these reasons, the previously-described effects of the second embodiment cannot be obtained in the structures described with reference to FIG. 10.

The above-described embodiments of the present invention are as follows.

A process cartridge 2 detachably attachable to a main body of an electrophotographic image forming apparatus, provided with:

an electrophotographic photosensitive drum 21 on which an electrostatic latent image is formed, process means (for example, a developing roller 22 and a charging roller 23) working on the electrophotographic photosensitive drum 21, a flexible member 26 for protecting the electrophotographic photosensitive drum 21 capable of taking a protection position in which the flexible member protects the same drum 21, and a retraction position in which the flexible member retracts from the protection position, a support member 25 which has a support portion 25*a* on which the flexible member 26 is supported, and which is provided pivotably on a frame of the cartridge 2, which support member 25 is adapted to move the flexible member 26 from the protection position to the retraction position, and a regulating member 27 provided on the flexible member 26 so as to regulate the positions of creases 26Q, 26R occurring on the flexible member 26 in accordance with a pivotal movement of the support member 25 and extending in parallel with the longitudinal direction (or the axis of rotation) of the electrophotographic photosensitive drum 21, the flexible member 26 being folded on the creases 26Q, 26R and moved to the retraction position.

In the condition in which the flexible member 26 is in the protection position, the flexible member 26 is bent to an outer side of the cartridge 2 so that the flexible member does not contact the electrophotographic photosensitive drum 21, the support portion 25*a* passing through a region between the regulating member 27 and electrophotographic photosensitive member 21 in accordance with the pivotal movement of the support member 25.

The flexible member 26 has:

a first crease 26Q occurring in a region between the regulating member 27 and support portion 25*a*, at which the flexible member support member 25 supports the flexible member 26, in accordance with the pivotal movement of the support member 25, and a second crease 26R occurring in a region between the regulating member 27 and support portion 2*a*, at which the process cartridge 2 supports the flexible member 26, in accordance with a further pivotal movement of the support member 25.

The cartridge 2 is provided with a handle 20 used when the cartridge 2 is attached to and detached from the main body of the apparatus, the regulating member 27 contacting the handle 20 when the flexible member 26 is folded in accordance with the pivotal movement of the support member 25, the handle 20 being thereby retracted to the retraction position.

The rigidity of the regulating member 27 is higher than that of the flexible member 26.

The regulating member 27 is a plate type regulating member 27 fixed to the flexible member 26.

The regulating member 27 is integrally molded with the same material as the flexible member, the thickness of the portion of the flexible member 26 which is not provided with the regulating member 27 being larger than that of the portion thereof which is provided with the regulating member 27.

An electrophotographic image forming apparatus 300, to and from which the process cartridge 2 can be attached and detached, adapted to be used to form an image on a recording medium P, provided with:

(i) an electrophotographic photosensitive drum 21 on which an electrostatic latent image is formed, process means (for example, a developing roller 22 and a charging roller 23) working on the electrophotographic photosensitive drum 21, a flexible member 26 protecting the electrophotographic photosensitive drum 21, and capable of taking a protection position in which the flexible member protects the electrophotographic photosensitive drum 21, and a retraction position in which the flexible member retracts from the protection position, a support member 25 having a support portion 25*a* on which the flexible member 26 is supported, provided pivotably on a frame of the cartridge 2, and adapted to move the flexible member 26 from the protection position to the retraction position, and a regulating member 27 provided on the flexible member 26 so as to regulate the positions of the creases 26Q and 26R which occur on the flexible member 26 in accordance with the pivotal movement of the support member 25, and which extend in parallel with the longitudinal direction (or the axis of rotation) of the electrophotographic photosensitive drum 21, the apparatus 300 having a mount 200 for fixing thereto detachably the process cartridge 2 in which the flexible member 26 is folded on the creases 26Q and 26R and moved to the retraction position, (ii) moving means (projection 102*a*) adapted to move the support member 25 so that the flexible member 26 is moved to the retraction position in accordance with an action of fixing the process cartridge 2 to the mount 200, and (iii) conveying means for conveying the recording medium P.

As described above, the present invention can provide a process cartridge of a simple construction in a space-saving manner, capable of protecting an electrophotographic photosensitive drum; and an electrophotographic image forming apparatus using the same process cartridge.

What is claimed is:

1. A process cartridge detachably attachable to a main body of an electrophotographic image forming apparatus, comprising:

an electrophotographic photosensitive member on which an electrostatic latent image is formed, process means acting on the electrophotographic photosensitive member, a flexible member adapted to protect said electrophotographic photosensitive member and capable of assuming a protection position in which said flexible member protects said electrophotographic photosensitive member and a retraction position in which said flexible member retracts from the protection position, a support member having a support portion on which said flexible member is supported, provided pivotably on a frame of said cartridge and adapted to move said flexible member from the protection position to the retraction position, and a regulating member provided on said flexible member so as to regulate the positions of creases which occur on said flexible member in response to a pivotal movement of said support member, and which extend parallel with the longitudinal direction of said electrophotographic photosensitive member, said flexible member being foldable on the creases and movable to the retraction position.

2. A process cartridge according to claim 1, wherein said flexible member is bent to an outer side of said process cartridge when said flexible member is in the protection position, in such a manner that said flexible member does not contact said electrophotographic photosensitive member, said support portion passing through a region between said regulating member and said electrophotographic photosensitive member in response to a pivotal movement of said support member.

3. A process cartridge according to claim 1, wherein said flexible member develops a first crease occurring in a region between said regulating member and said support portion in response to a pivotal movement of said support member, and a second crease occurring in a region between said regulating member and said support portion at which said cartridge supports said flexible member, in response to a further pivotal movement of said support member beyond the pivotal movement performed to create the first crease.

4. A process cartridge according to claim 2 or 3, wherein the rigidity of said regulating member is higher than that of said flexible member.

5. A process cartridge according to claim 2 or 3, wherein said regulating member is a plate-type regulating member fixed to said flexible member.

6. A process cartridge according to claim 1, wherein said cartridge further comprises a handle facilitating attachment of said cartridge to and detachment of said cartridge from the main body of the apparatus, and said regulating member contacts said handle when said flexible member is folded in response to a pivotal movement of said support member, to cause said handle to retract to a retraction position.

7. A process cartridge according to claim 1, wherein said regulating member is integrally molded with the same material as said flexible member, wherein the thickness of the portion of said flexible member which is provided with said regulating member is larger than that of the portion thereof which is not provided with said regulating member.

8. An electrophotographic image forming apparatus to which a process cartridge can be attached and from which the process cartridge can be detached, and adapted to be used to form an image on a recording medium, comprising:

(i) a mount configured and positioned to detachabley mount the process cartridge, the process cartridge including an electrophotographic photosensitive member on which an electrostatic latent image is formed, process means acting on the electrophotographic photosensitive member, a flexible member protecting the electrophotographic photosensitive member, and capable of assuming a protection position in which the flexible member protects the electrophotographic photosensitive member, and a retraction position in which the flexible member retracts from the protection position, a support member having a support portion on which the flexible member is supported, provided pivotably on a frame of the cartridge, and adapted to move the flexible member from the protection position to the retraction position, and a regulating member provided on the flexible member so as to regulate the positions of the creases which occur on the flexible member in accordance with a pivotal movement of the support member, and which extend parallel with the longitudinal direction of the electrophotographic photosensitive member, the flexible member being foldable on the creases and movable to the retraction position, (ii) moving means for moving the support member so that the flexible member is moved to the retraction position in accordance with an action of fixing the process cartridge to the mount, and (iii) conveying means for conveying the recording medium.

* * * * *

UNITED STATES PATENT AND TRADEMARK OFFICE

CERTIFICATE OF CORRECTION

PATENT NO. : 6,990,302 B2
APPLICATION NO. : 10/715485
DATED : January 24, 2006
INVENTOR(S) : Toba et al.

It is certified that error appears in the above-identified patent and that said Letters Patent is hereby corrected as shown below:

COLUMN 1:
Line 38, "be" should read --can be--.
Line 48, "be not" should read --not be--.

COLUMN 2:
Line 8, "have" should read --and have--.
Line 59, FIG. 5 is a" should read --FIGS. 5A to 5E are-- and "view" should read --views--.
Line 65, "FIG. 7 is a" should read --FIGS. 7A to 7E are-- and "view" should read --views--.

COLUMN 3:
Line 1, "FIG. 8 is a" should read --FIGS. 8A to 8E are-- and "view" should read --views--.
Line 5, "FIG. 9 is a" should read --FIGS. 9A to 9E are-- and "view" should read --views--.
Line 9, "FIG. 10 is a" should read --FIGS. 10A to 10E are-- and "view" should read --views--.

COLUMN 4:
Line 67, "of" should read --of the--.

COLUMN 5:
Line 55, "hand," should read --other hand,--.

COLUMN 8:
Line 18, "5, 8 and 9." should read --5A to 5E, 8A, to 8E and 9A to 9E.--
Line 22, "FIG. 5 is a" should read --FIGS. 5A to 5E are-- and "view" should read --views--.
Line 24, "FIG. 8 is a" should read --FIGS. 8A to 8E are--.
Line 25, "view" should read --views--.
Line 28, "FIG. 9 is a" should read --FIGS. 9A to 9E are--.
Line 29, "view" should read --views--.
Line 33, "FIGS. 8 and 9" should read --FIGS. 8A to 8E and 9A to 9E--.
Line 35, "easily"should read --easily and--.

COLUMN 9:
Line 25, "(FIG. 5D" should read --(FIG. 5D)--.
Line 60, "by" should read --by a--.

UNITED STATES PATENT AND TRADEMARK OFFICE

CERTIFICATE OF CORRECTION

PATENT NO. : 6,990,302 B2
APPLICATION NO. : 10/715485
DATED : January 24, 2006
INVENTOR(S) : Toba et al.

It is certified that error appears in the above-identified patent and that said Letters Patent is hereby corrected as shown below:

COLUMN 10:
Line 10, "a path" should read --and a path--.
Line 32, "FIG. 8" should read --FIGS. 8A to 8E--.
Line 42, "FIG. 9" should read --FIGS. 9A to 9E--.
Line 48, "direction" should read --direction of--.
Line 57, FIGS. 8 and 9." should read --FIGS. 8A to 8E and 9A to 9E.--
Line 61, "7 and 10." should read --7A to 7E and 10A to 10E.--

COLUMN 11:
Line 6, "FIG. 7 is a" should read --FIGS. 7A to 7E are-- and "view" should read --views--.
Line 8, "FIG. 10 is a" should read --FIGS 10A to 10E are--.
Line 9, "view" should read --views--.
Line 13, "FIG. 10" should read --FIGS. 10A to 10E--.
Line 14, "easily" should read --easily and--.
Line 35, "FIG. 7," should read --FIGS. 7A to 7E,--.
Line 57, "reside' should read --resides--.

COLUMN 12:
Line 45, "FIG. 10" should read --FIGS. 10A to 10E.--

COLUMN 13:
Line 57, "develops" should read --develops:--.

Signed and Sealed this

Eighth Day of August, 2006

JON W. DUDAS
*Director of the United States Patent and Trademark Office*